US009435196B2

(12) United States Patent
Switzer et al.

(10) Patent No.: US 9,435,196 B2
(45) **Date of Patent: *Sep. 6, 2016**

(54) DOWNHOLE ELECTROMAGNETIC AND MUD PULSE TELEMETRY APPARATUS

(71) Applicant: EVOLUTION ENGINEERING INC., Calgary (CA)

(72) Inventors: David A. Switzer, Calgary (CA); Jili Liu, Calgary (CA); Aaron William Logan, Calgary (CA); Mingdong Xu, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/044,291

(22) Filed: Feb. 16, 2016

(65) Prior Publication Data

US 2016/0160637 A1 Jun. 9, 2016

Related U.S. Application Data

(63) Continuation of application No. 14/189,895, filed on Feb. 25, 2014, now Pat. No. 9,291,049.

(60) Provisional application No. 61/769,033, filed on Feb. 25, 2013.

(51) Int. Cl.

| | |
|---|---|
| ***G01V 3/00*** | (2006.01) |
| ***E21B 47/12*** | (2012.01) |
| ***E21B 47/18*** | (2012.01) |

(52) U.S. Cl.

CPC ..... *E21B 47/12* (2013.01); *E21B 47/122* (2013.01); *E21B 47/18* (2013.01)

(58) Field of Classification Search

CPC ..... E21B 47/122; E21B 47/18

See application file for complete search history.

(56) References Cited

U.S. PATENT DOCUMENTS 4,945,761 A 8/1990 Lessi et al.
6,144,316 A 11/2000 Skinner (Continued)

FOREIGN PATENT DOCUMENTS

CA 2617328 A1 8/2003
CA 2634236 A1 10/2007

(Continued)

OTHER PUBLICATIONS

Cathedral FUSION MWD Brochure, Jan. 14, 2012.

(Continued)

*Primary Examiner* — Omeed Alizada

(74) *Attorney, Agent, or Firm* — Oyen Wiggs Green & Mutala LLP

(57) ABSTRACT

A measurement-while-drilling (MWD) telemetry system comprises a downhole MWD telemetry tool comprising a mud pulse (MP) telemetry unit and an electromagnetic (EM) telemetry unit. The MWD telemetry tool can be configured to transmit data in an EM-only telemetry mode using only the EM telemetry unit, in an MP-only mode using only the MP telemetry unit, or in a concurrent telemetry mode using both the EM and MP telemetry units concurrently. When transmitting data in the concurrent telemetry mode, the telemetry tool can be configured to transmit in a concurrent confirmation mode wherein the same telemetry data is transmitted by each of the EM and MP telemetry units, or in a concurrent shared mode wherein some of the telemetry data is transmitted by the EM telemetry unit, and the rest of the telemetry data is transmitted by the MP telemetry unit. The telemetry tool can be programmed to change its operating telemetry mode in response to a downlink command sent by an operator at surface.

16 Claims, 13 Drawing Sheets

(56) References Cited

U.S. PATENT DOCUMENTS

| | | | |
|---|---|---|---|
| 6,188,222 | B1 | 2/2001 | Seydoux et al. |
| 6,391,184 | B1 | 5/2002 | Orolin et al. |
| 6,405,136 | B1 | 6/2002 | Li et al. |
| 6,902,414 | B2 | 6/2005 | Dopf et al. |
| 6,909,667 | B2 | 6/2005 | Shah et al. |
| 7,163,065 | B2 | 1/2007 | Zhang et al. |
| 7,348,894 | B2 | 3/2008 | Bailey et al. |
| 7,462,957 | B2 | 12/2008 | Camwell et al. |
| 7,552,761 | B2 | 6/2009 | Moriarty |
| 7,565,936 | B2 | 7/2009 | Zhang et al. |
| 7,573,397 | B2 | 8/2009 | Petrovic et al. |
| 7,839,719 | B2 | 11/2010 | Dopf et al. |
| 7,880,640 | B2 | 2/2011 | Lovell et al. |
| 7,881,802 | B2 | 2/2011 | Quiles et al. |
| 7,894,302 | B2 | 2/2011 | Aiello et al. |
| 7,994,932 | B2 | 8/2011 | Huang et al. |
| 8,120,509 | B2 | 2/2012 | Young |
| 8,154,420 | B2 | 4/2012 | Petrovic et al. |
| 8,483,849 | B2 | 7/2013 | Recknagel et al. |
| 2003/0151977 | A1 | 8/2003 | Shah |
| 2006/0132335 | A1 | 6/2006 | Kojima |
| 2006/0198242 | A1 | 9/2006 | Geerits et al. |
| 2007/0247328 | A1 | 10/2007 | Petrovic et al. |
| 2008/0136665 | A1 | 6/2008 | Aiello et al. |
| 2009/0038851 | A1 | 2/2009 | Camwell et al. |
| 2009/0045973 | A1 | 2/2009 | Rodney et al. |
| 2009/0115625 | A1 | 5/2009 | Young |
| 2009/0120689 | A1 | 5/2009 | Zaeper et al. |
| 2010/0098045 | A1 | 4/2010 | Miyazaki |
| 2010/0194586 | A1 | 8/2010 | Tjhang et al. |
| 2010/0201540 | A1 | 8/2010 | Li et al. |
| 2012/0085583 | A1 | 4/2012 | Logan et al. |
| 2012/0256759 | A1 | 10/2012 | Petrovic et al. |
| 2013/0134304 | A1 | 5/2013 | Beekman et al. |
| 2013/0192357 | A1 | 8/2013 | Ramshaw et al. |
| 2015/0167392 | A1 | 6/2015 | Sugiura |

FOREIGN PATENT DOCUMENTS

| | | | |
|---|---|---|---|
| CA | 2666695 | A1 | 10/2007 |
| CA | 2624039 | A1 | 9/2008 |
| CA | 2584671 | | 2/2009 |
| CA | 2544457 | C | 7/2009 |
| CA | 2633904 | | 8/2009 |
| MX | 2010008773 | A | 2/2011 |
| WO | 2010121344 | A1 | 10/2010 |
| WO | 2010121345 | A1 | 10/2010 |
| WO | 2010121346 | A1 | 10/2010 |

OTHER PUBLICATIONS www.mostardirectional.com, Oct. 7, 2011.
National Oilwell Varco Blackstar EMWD brochure, Apr. 23, 2007.
Extreme Engineering XPulse specification sheet, Oct. 9, 2012.

CONFIDENCE IN EM DATA BEFORE COMPARISON

| CONFIDENCE IN MP DATA BEFORE COMPARISON | HIGH | MED | NO |
|---|---|---|---|
| HIGH | CONFIRMED OR USE BEST | CONFIRMED OR USE BEST | USE MP |
| MED | CONFIRMED OR USE BEST | CONFIRMED OR USE BEST | USE MP |
| NO | USE EM | USE EM | NO DATA |

FIG. 9

DOWNHOLE ELECTROMAGNETIC AND MUD PULSE TELEMETRY APPARATUS

CROSS-REFERENCE TO RELATED APPLICATION

This application is a continuation of U.S. application Ser. No. 14/189,895 filed 25 Feb. 2014, which claims the benefit under 35 U.S.C. §119 of U.S. Application No. 61/769,033 filed 25 Feb. 2013 and entitled DOWNHOLE ELECTROMAGNETIC AND MUD PULSE TELEMETRY APPARATUS, both of which are hereby incorporated herein by reference for all purposes.

FIELD

This invention relates generally to downhole telemetry, and in particular to a downhole electromagnetic and mud pulse telemetry apparatus.

BACKGROUND ART

The recovery of hydrocarbons from subterranean zones relies on the process of drilling wellbores. The process includes drilling equipment situated at surface, a drill string extending from the surface equipment to the formation or subterranean zone of interest. The drill string can extend thousands of meters below the surface. The terminal end of the drill string includes a drill bit for drilling (or extending) the wellbore. The system relies on a drilling mud which is pumped through the inside of the drill string, cools and lubricates the drill bit and then exists out of the drill bit and carries the rock cuttings back to surface. The mud also helps control bottom hole pressure and prevents hydrocarbon influx from the formation into the wellbore and potential blow out at surface.

Directional drilling is the process of steering a well from vertical to intersect a target endpoint or follow a prescribed path. At the terminal end of the drill string, is a bottom-hole-assembly (or BHA) which comprises 1) a drill bit; 2) a steerable downhole mud motor of rotary steerable system; 3) sensors of survey equipment Logging While Drilling (LWD) and/or Measurement-while-drilling (MWD) to evaluate downhole conditions as well depth progresses; 4) means for transmitting telemetry data to surface; and 5) other control processes such as stabilizers or heavy weight drill collars. The BHA is conveyed into the wellbore typically within a metallic tubular. The mud motor has a drive shaft that uses the drilling fluid passing through it to rotate the bit (rather than the surface rig spinning the entire drill string as in conventional drilling of vertical wells). The outer housing of the mud motor has a bend in it which can be oriented to push or deflect the drill bit in a desired direction, allowing the driller to steer the well. Measurement While Drilling (MWD) equipment is used to provide downhole sensor and status information to surface while drilling in a near real-time mode. This information is used by the rig crew to make decisions about controlling and steering the well to optimize the drilling speed and trajectory based on numerous factors, including lease boundaries, existing wells, formation properties, hydrocarbon size and location, etc. This can include making intentional deviations from the planned wellbore path as necessary based on the information gathered from the downhole sensors during the drilling process. The ability to obtain real time data measurements while drilling allows for a relatively more economical and more efficient drilling operation.

Downhole MWD tools typically contain similar sensor packages to survey the well bore and surrounding formation, but can feature a number of different telemetry transmitting means. Such telemetry means include acoustic telemetry, fibre optic cable, mud pulse (MP) telemetry and electromagnetic (EM) telemetry.

MP telemetry involves creating pressure waves in the circulating drill mud in the drill string. Information acquired by the downhole sensors is transmitted in specific time divisions by creating a series of pressure waves in the mud column. This is achieved by changing the flow area and/or path of the drilling fluid as it passes the MWD tool in a timed, coded sequence, thereby creating pressure differentials in the drilling fluid. The pressure differentials or pulses may either be negative pulse or positive pulses in nature. The pulses travel to surface to be decoded by transducers in the surface piping, reconstructing the data sent from the downhole sensor package. One or more signal processing techniques are used to separate undesired mud pump noise, rig noise or downward propagating noise from upward (MWD) signals. The data transmission rate is governed by acoustic waves in a drilling mud and is typically about 1.1 to 1.5 km/s.

EM telemetry involves the generation of electromagnetic waves which travel through the earth's surrounding formations from the wellbore, with detection of the waves at surface. In EM telemetry systems, a very low frequency alternating current is driven across a gap sub, which is typically part of the BHA. The gap sub comprises an electrically isolated ('nonconductive"), effectively creating an insulating break ("gap") between the bottom of the drill string to the drill bit, and the longer top portion that includes the rest of the drill pipe up to the surface. The lower part of the drill string below the gap typically is set as a ground but the polarity of the members can be switched. An EM telemetry signal comprising a low frequency AC voltage is controlled in a timed/coded sequence to energize the earth and create a measurable voltage differential between the surface ground and the top of the drill string. The EM signal which originated across the gap is detected at surface and measured as a difference in the electric potential from the drill rig to various surface grounding rods located about the lease site.

MP and EM telemetry systems each have their respective strengths and weaknesses. For instance, MP telemetry systems tend to provide good depth capability, independence on earth formation, and current strong market acceptance. However, MP telemetry systems tend to provide generally slower baud rates and more narrow bandwidths compared to EM telemetry, and require mud to be flowing in order for telemetry to be transmitted. Thus, MP telemetry systems are incompatible with air/underbalanced drilling, which is a growing market in North America.

In contrast, EM telemetry systems generally provide faster baud rates and increased reliability due to no moving downhole parts compared to MP telemetry systems, high resistance to lost circulating material (LCM) use, and are suitable for air/underbalanced drilling. Unlike MP telemetry systems, EM telemetry systems transmit data through the earth formation and not through a continuous fluid column; hence EM telemetry can be transmitted when there is no mud flowing through the drill string. However, EM telemetry systems can be incompatible with some formations such as formations containing high salt content or formations of high resistivity contrast. Also, EM transmissions can be strongly attenuated over long distances through the earth formations, with higher frequency signals attenuating faster than low frequency signals, and thus EM telemetry tends to require a relatively large amount of power and/or utilize relatively low frequencies so that the signals can be detected at surface. These limitations create challenges with battery life and lowered data rate transmission in the downhole MWD tool.

Recently, combined telemetry systems including both EM and MP telemetry means have been proposed. However, such known combined telemetry systems are relatively underdeveloped, and for instance, often simply stack a known EM tool and a known MP tool in series with minimal system integration. Such known combined telemetry systems also do not feature sophisticated data management between the EM and MP telemetry tools, and thus are not optimized for performance, reliability, and efficient power consumption.

SUMMARY

According to one aspect of the invention there is provided a method of transmitting downhole measurement data to surface comprising: reading downhole measurement data and selecting an available telemetry transmission mode from a group consisting of: mud pulse (MP)-only telemetry mode, electromagnetic (EM)-only telemetry mode, MP and EM concurrent shared telemetry mode, and MP and EM concurrent confirmation telemetry mode. When the MP-only telemetry mode is selected, the method further comprises encoding the measurement data into a first MP telemetry signal and transmitting the first MP telemetry signal to surface. When the EM-only mode is selected, the method further comprises encoding the measurement data into a first EM telemetry signal and transmitting the first EM telemetry signal to surface. When the concurrent shared telemetry mode is selected, the method further comprises encoding a first selection of the measurement data into a second MP telemetry signal and a second selection of the measurement data into a second EM telemetry signal, and transmitting the second MP and EM telemetry signals to surface. When the concurrent confirmation telemetry mode is selected, the method further comprises encoding the same measurement data into a third MP telemetry signal and into a third EM telemetry signal; and transmitting the third MP and EM telemetry signals to surface.

The method can further comprise receiving a downlink command containing instructions to select one of the available telemetry transmission modes, in which case the step of selecting an available telemetry mode is made in accordance with these instructions. The downlink command can contain instructions to execute one of a set of configuration files, wherein each configuration file includes instructions to select one of the available telemetry modes. The step of selecting an available telemetry mode would thus comprise executing at least a portion of the configuration files. Each configuration file can further include instructions to select a type of message frame to be sent in a telemetry transmission, a composition of the message frame, and a modulation scheme to encode the measurement data into one of the first, second, and third EM or MP telemetry signals. The method can thus further comprise encoding the measurement data according to the selected modulation scheme, and wherein the first, second, or third EM or MP telemetry signals comprise the selected message type and composition.

The measurement data can comprise gamma, shock, vibration and toolface data. When the concurrent shared telemetry mode is selected, the method further can comprise: encoding the gamma, shock and vibration data into the second EM telemetry signal and encoding the toolface data into the second MP telemetry signal; or, encoding the gamma and toolface data on the second EM telemetry signal and encoding the shock and vibration data on the second MP telemetry signal; or, encoding the gamma data on the second EM telemetry signal, and encoding the shock, vibration and toolface data on the second MP telemetry signal.

According to another aspect of the invention, there is provided a downhole telemetry method for transmitting telemetry data in a concurrent shared mode, comprising, at a downhole location: reading measurement data and encoding some of the measurement data into an electromagnetic (EM) telemetry signal and the rest of the measurement data into a mud pulse (MP) telemetry signal, then transmitting the EM and MP telemetry signals to surface wherein at least part of the EM and MP telemetry signals are transmitted concurrently. The step of reading measurement data can comprise acquiring survey data, in which case at least some of the survey data is encoded into an EM telemetry signal survey frame and at least some of the measurement data is encoded into an MP telemetry signal survey frame, and at least part of the EM telemetry signal survey frame is transmitted during a period of no mud flow, and the MP survey frame is transmitted during a period of mud flow.

In accordance with another aspect of the invention, there is provided a downhole telemetry method for transmitting telemetry data in a concurrent confirmation mode, comprising, at a downhole location: reading measurement data and encoding the same measurement data into an electromagnetic (EM) telemetry signal and into a mud pulse (MP) telemetry signal, then transmitting the EM and MP telemetry signals to surface, wherein at least part of the EM and MP telemetry signals are transmitted concurrently; and, at a surface location: receiving the EM and MP telemetry signals, comparing the received signals and decoding at least one of the received signals when the signals meet a match threshold. The step of concurrently transmitting the EM and MP telemetry signals can comprise time-synchronizing an active frame of each telemetry signal, wherein each active frame contains a same subset of the measurement data.

An error check matching protocol can be conducted on each received signal, and a confidence value can be assigned to each received signal based on results from the error check matching protocol. The signal with the highest confidence value is selected when the signals do not meet a match threshold. A signal-to-noise ratio (SNR) of each received signal can be determined and the signal with the highest SNR can be selected when the signals to do not meet a match threshold and the signals have a same non-zero confidence value. A no data indicator can be outputted when the signals do not meet a match threshold and the signals are both assigned a zero confidence value.

According to another aspect of the invention there is provided a downhole telemetry tool comprising: sensors for acquiring downhole measurement data; an electromagnetic (EM) telemetry unit; a mud pulse (MP) telemetry unit; at least one control module communicative with the sensors and EM and MP telemetry units and comprising a processor and a memory having encoded thereon program code executable by the processor to perform any of the above methods, wherein steps of transmitting the first, second or third EM signals are carried out by the EM telemetry unit, and the steps of transmitting the first, second or third MP telemetry signals are carried out by the MP telemetry unit. The sensors can comprise drilling conditions sensors and directional and inclination (D&I) sensors. The drilling conditions sensors can comprise an axial and lateral shock sensor, an RPM gyro sensor and a flow switch sensor. The D&I sensors can include a three axis accelerometer, a three axis magnetometer, and a gamma sensor, and back-up sensors.

The telemetry tool can further comprise multiple control modules and a communications bus in communication with each of the multiple control modules. The multiple control modules include a control sensor control module communicative with the drilling conditions sensors, an interface control module communicative with the D&I sensors, an EM control module communicative with the EM telemetry unit, an MP control module communicative with the MP telemetry unit, and a power management control module. The control sensor control module can comprise a processor and a memory having encoded thereon program code executable by the processor to decode downlink command instructions from a downlink command signal received by one of the drilling conditions sensors, and to transmit the downlink command instructions to other control modules via the communications bus. The EM control module, MP control module and interface control module can each comprise a processor and a memory; each memory of each control module contains at least a portion of each configuration file in the set of configuration files.

The sensors can further comprise a pressure sensor communicative with the power management control module. The power management control module can comprise a processor and a memory having encoded thereon program code executable by the processor to decode downlink command instructions from a pressure downlink command signal received by the pressure sensor and to transmit the downlink command instructions to the other control modules via the communications bus.

The downlink command instructions can comprise a selected configuration file from the set of configuration files, in which case each memory of each control module comprises program code to execute the portion of the selected configuration file contained in the respective memory.

BRIEF DESCRIPTION OF FIGURES

FIG. 9 is a logic diagram of steps performed by surface receiving and processing equipment of the EM telemetry system to determine the confidence value of received EM and MP telemetry signals that were transmitted by the MWD telemetry tool while operating in the concurrent confirmation mode.

DETAILED DESCRIPTION

Overview

Embodiments of the present invention described herein relate to a MWD telemetry system comprising a downhole MWD telemetry tool comprising a MP telemetry unit and an EM telemetry unit. The MWD telemetry tool can be configured to transmit data in an EM-only telemetry mode using only the EM telemetry unit, in an MP-only mode using only the MP telemetry unit, or in a concurrent telemetry mode using both the EM and MP telemetry units concurrently. When transmitting data in the concurrent telemetry mode, the telemetry tool can be configured to transmit in a concurrent confirmation mode wherein the same telemetry data is transmitted by each of the EM and MP telemetry units, or in a concurrent shared mode wherein some of the telemetry data is transmitted by the EM telemetry unit, and the rest of the telemetry data is transmitted by the MP telemetry unit. The telemetry tool can be programmed to start operating using a selected telemetry mode, and change its operating telemetry mode in response to a downlink command sent by an operator at surface.

By being able to operate in a number of different telemetry modes, the telemetry tool offers an operator flexibility to operate the telemetry system in a preferred manner. For example, the operator can increase the transmission bandwidth of the telemetry tool by operating in the concurrent shared mode, since both the EM and MP telemetry units are concurrently transmitting telemetry data through separate channels. Or, the operator can increase the reliability and accuracy of the transmission by operating in the concurrent confirmation mode, since the operator has the ability to select the telemetry channel having a higher confidence value. Or, the operator can conserve power by operating in one of MP-only or EM-only telemetry modes. Further, the operator can choose the MP-only or EM-only modes based on which mode best suits the operating conditions; for example, if the reservoir formation requires an EM telemetry unit to transmit at a very low frequency in order for an EM telemetry signal to reach surface, the result low baud rate may dictate that the operator select to transmit using the MP-only mode. Conversely, when there is no mud flowing (e.g. while air drilling), the operator can select the EM-only mode to transmit telemetry data.

Figure 1:
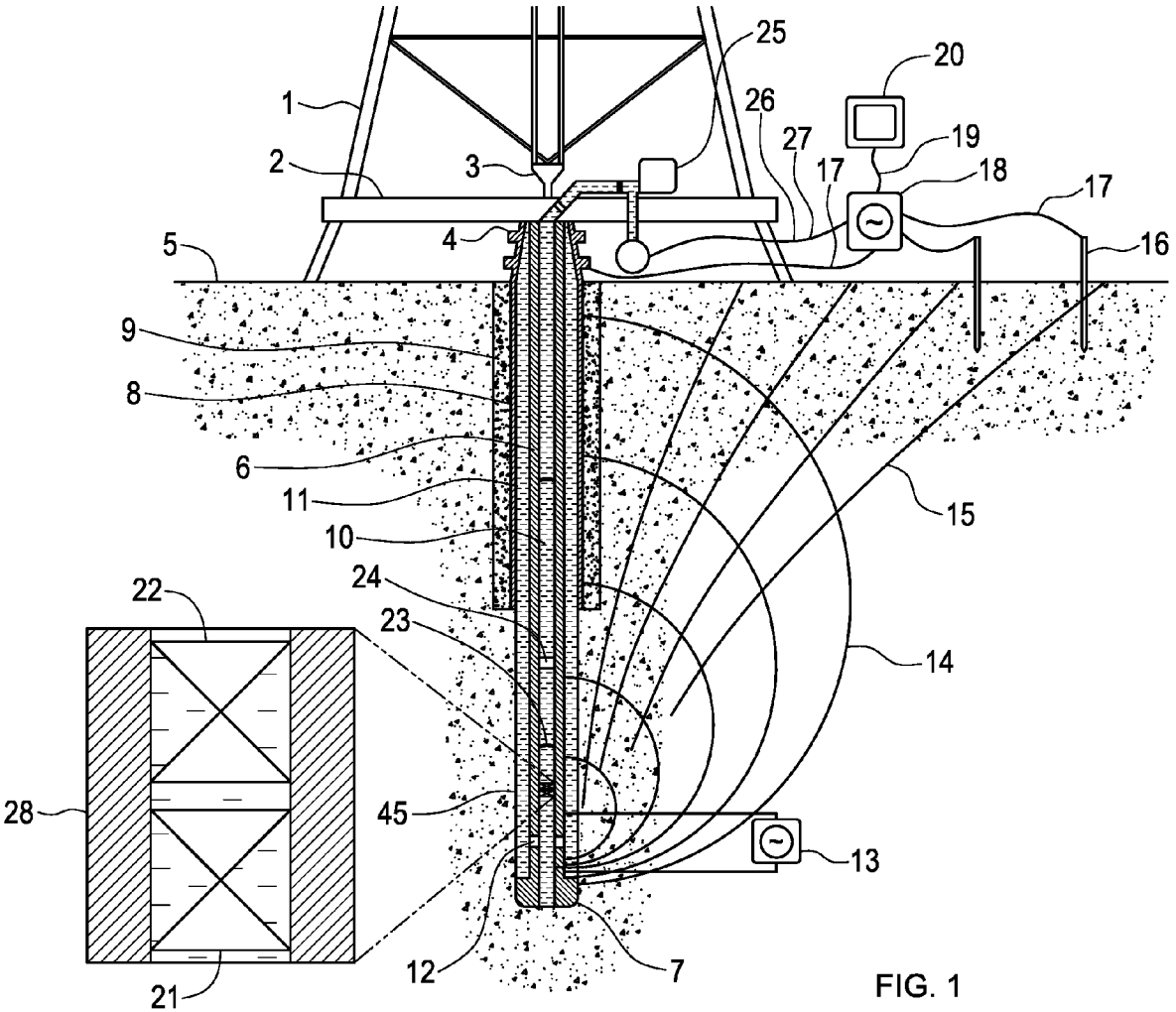
FIG. 1 is a schematic side view of a measurement-while-drilling (MWD) telemetry system in operation, according to embodiments of the invention.

Referring to FIG. 1, there is shown a schematic representation of a downhole drilling operation in which various embodiments of the present invention can be employed. Downhole drilling equipment including a derrick 1 with a rig floor 2 and draw works 3 facilitate rotation of drill pipe 6 into the ground 5. The drill pipe 6 is enclosed in casing 8 which is fixed in position by casing cement 9. Bore drilling fluid 10 is pumped down the drill pipe 6 and through an electrically isolating gap sub assembly 12 by a mud pump 25 to a drill bit 7. Annular drilling fluid 11 is then pumped back to the surface and passes through a blow out preventer ("BOP") 4 positioned above the ground surface. The gap sub assembly 12 is electrically isolated (nonconductive) at its center joint effectively creating an electrically insulating break, known as a gap between the two and bottom parts of the gap sub assembly 12. The gap sub assembly 12 may form part of the BHA and be positioned at the top part of the BHA, with the rest of the BHA below the gap sub assembly 12 and the drill pipe 6 above the gap sub assembly 12 each forming an antennae for a dipole antennae.

The MWD system comprises a downhole MWD telemetry tool 45 and surface receiving and processing equipment 18. The telemetry tool 45 comprises an EM telemetry unit 13 having an EM signal generator which generates an alternating electrical current 14 that is driven across the gap sub assembly 12 to generate carrier waves or pulses which carry encoded telemetry data ("EM telemetry transmission"). The low frequency AC voltage and magnetic reception is controlled in a timed/coded sequence by the telemetry tool 45 to energize the earth and create an electrical field 15, which propagates to the surface and is detectable by the surface receiving and processing equipment 18 of the MWD telemetry system. The telemetry tool 45 also includes a MP telemetry unit 28 having a MP signal generator for generating pressure pulses in the drilling fluid 10 which carry encoded telemetry data ("MP telemetry transmission").

At surface, the surface receiving and processing equipment includes a receiver box 18, computer 20 and other equipment to detect and process both EM and MP telemetry transmissions. To detect EM telemetry transmissions, communication cables 17 transmit the measurable voltage differential from the top of the drill string and various surface grounding rods 16 located about the drill site to EM signal processing equipment, which receives and processes the EM telemetry transmission. The grounding rods 16 are generally randomly located on site with some attention to site operations and safety. The EM telemetry signals are received by the receiver box 18 and then transmitted to the computer 20 for decoding and display, thereby providing EM measurement-while-drilling information to the rig operator. To detect MP telemetry transmissions, a pressure transducer 26 that is fluidly coupled with the mud pump 25 senses the pressure pulses 23,24 and transmits an electrical signal, via a pressure transducer communication cable 27, to MP signal processing equipment for processing. The MP telemetry transmission is decoded and decoded data is sent to the computer display 20 via the communication cable 19, thereby providing MP measurement-while-drilling information to the rig operator.

Downhole Telemetry Tool

Figure 2:
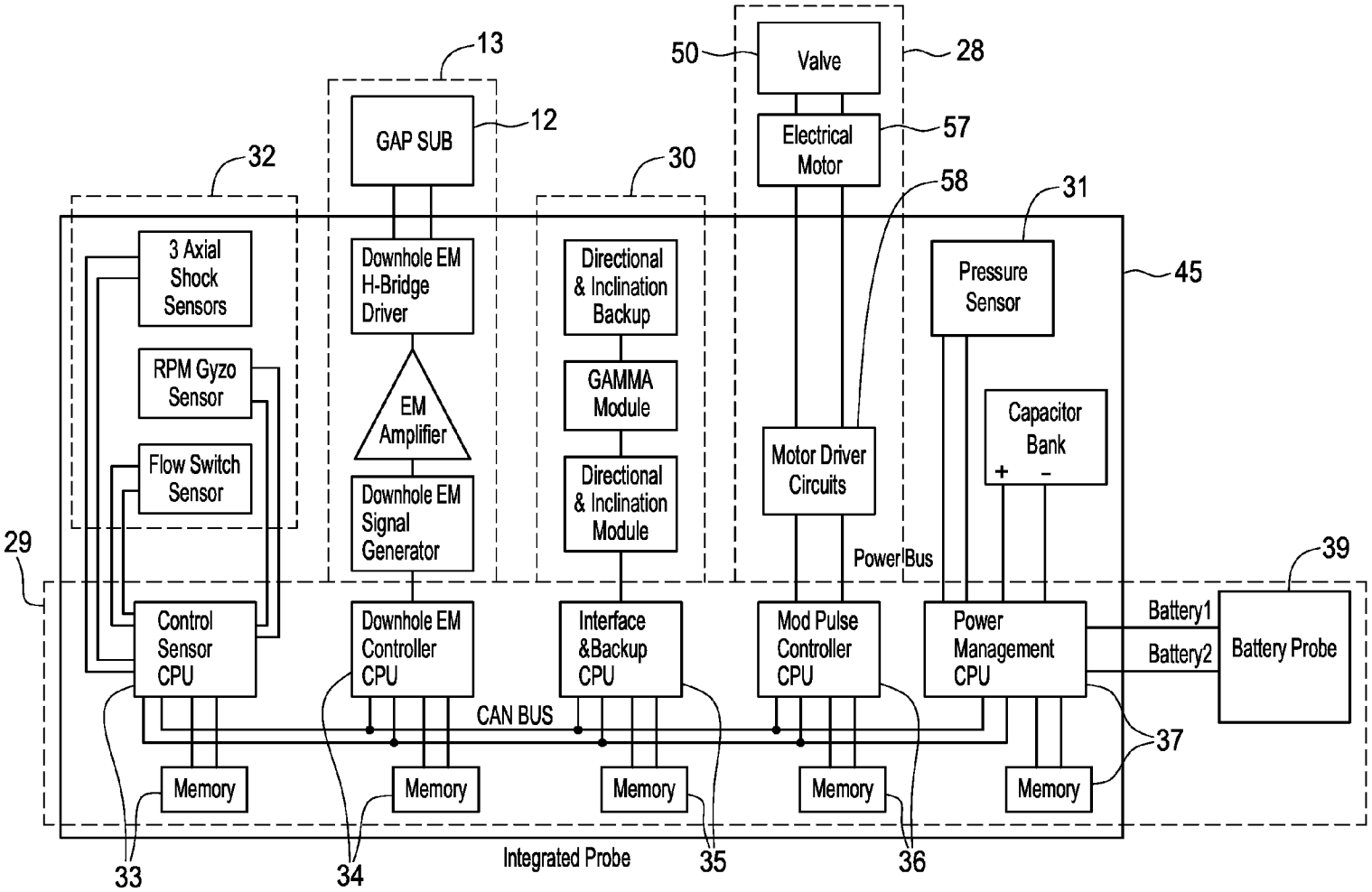
FIG. 2 is a schematic block diagram of components of a downhole MWD telemetry tool of the MWD telemetry system comprising an EM telemetry unit and an MP telemetry unit according to one embodiment.

Referring now to FIG. 2, the downhole telemetry tool 45 generally comprises the EM telemetry unit 13, the MP telemetry unit 28, sensors 30, 31, 32 and an electronics subassembly 29. The electronics subassembly 29 comprises one or more processors and corresponding memories which contain program code executable by the corresponding processors to encode sensor measurements into telemetry data and send control signals to the EM telemetry unit 13 to transmit EM telemetry signals to surface, and/or send control signal to the MP telemetry unit 28 to transmit MP telemetry signals to surface.

The sensors include directional and inclination (D&I) sensors 30; a pressure sensor 31, and drilling conditions sensors 32. The D&I sensors 30 comprise three axis accelerometers, three axis magnetometers, a gamma sensor, backup sensors, and associated data acquisition and processing circuitry. Such D&I sensors 30 are well known in the art and thus are not described in detail here. The drilling conditions sensors 32 include sensors for taking measurements of borehole parameters and conditions including shock, vibration, RPM, and drilling fluid (mud) flow, such as axial and lateral shock sensors, RPM gyro sensors and a flow switch sensor. The pressure sensor 31 is configured to measure the pressure of the drilling fluid outside the telemetry tool 45. Such sensors 31, 32 are also well known in the art and thus are not described in detail here.

The telemetry tool 45 can feature a single processor and memory module ("master processing unit"), or several processor and memory modules. The processors can be any suitable processor known in the art for MWD telemetry tools, and can be for example, a dsPIC33 series MPU. In this embodiment, the telemetry tool 45 comprises multiple processors and associated memories, namely: a control sensor CPU and corresponding memory ("control sensor control module") 33 communicative with the drilling conditions sensors 32, an EM signal generator CPU and corresponding memory ("EM control module") 34 in communication with the EM signal generator 13, an interface and backup CPU and corresponding memory ("interface control module") 35 in communication with the D&I sensors 30, a MP signal generator CPU and corresponding memory ("MP control module") 36 in communication with the MP signal generator 28, and a power management CPU and corresponding memory ("power management control module") 37 in communication with the pressure sensor 31.

The telemetry tool 45 also comprises a capacitor bank 38 for providing current during high loads, batteries 39 which are electrically coupled to the power management control module 37 and provide power to the telemetry tool 45, and a CANBUS communications bus 40. The control modules 33, 34, 35, 36, 37 are each communicative with the communications bus 40, which allows data to be communicated between the control modules 33, 34, 35, 36, 37, and which allows the batteries 39 to power the control modules 33, 34, 35, 36, 37 and the connected sensors 30, 31, 32 and EM and MP telemetry units 13, 28. This enables the EM control module 34 and MP control module 36 to independently read measurement data from the sensors 30, 32, as well as communicate with each other when operating in the concurrent shared or confirmation telemetry modes.

The control sensor control module 33 contains program code stored in its memory and executable by its CPU to read drilling fluid flow measurements from the drilling conditions sensors 32 and determine whether mud is flowing through the drill sting, and transmit a "flow on" or a "flow off" state signal over the communications bus 40. The control sensor control module 32 memory also includes executable program code for reading gyroscopic measurements from the drilling conditions sensors 32 and to determine drill string RPM and whether the drill string is in sliding or a rotating state, and then transmit a "sliding" or "rotating" state signal over the communications bus 40. The control sensor control module 32 memory further comprises executable program code for reading shock measurements from shock sensors of the drilling conditions sensors 32 and send out shock level data when requested by the EM controller module 34 and/or the MP control module 36.

The interface control module 35 contains program code stored in its memory and executable by its CPU to read D&I and gamma measurements from the D&I sensors 30, determine the D&I of the BHA and send this information over the communications bus 40 to the EM control module 34 and/or MP control module 36 when requested.

The power management control module 37 contains program code stored in its memory and executable by its CPU to manage the power usage by the telemetry tool 45. The power management module 37 can contain further program code that when executed reads pressure measurements from the pressure sensor 31, determines if the pressure measurements are below a predefined safety limit, and electrically disconnects the batteries 39 from the rest of the telemetry tool 45 until the readings are above the safety limit.

The sensors 30, 31, 32, and electronics subassembly 29 can be mounted to a main circuit board and located inside a tubular housing (not shown). Alternatively, some of the sensors 30, 31, 32 such as the pressure sensor 31 can be located elsewhere in the telemetry tool 45 and be communicative with the rest of the electronics subassembly 29. The main circuit board also contains the communications bus 40 and can be a printed circuit board with the control modules 33, 34, 35, 36, 37 and other electronic components soldered on the surface of the board. The main circuit board and the sensors 30, 31, 32 and control modules 33, 34, 36, 36, 37 are secured on a carrier device (not shown) which is fixed inside the housing by end cap structures (not shown).

As will be described below, the memory of each of the EM and MP control modules 34, 36 contains encoder program code that is executed by the associated CPU 34, 36 to perform a method of encoding measurement data into an EM or MP telemetry signal that can be transmitted by the EM signal generator 13 using EM carrier waves or pulses to represent bits of data, or by the MP signal generator 28 using mud pulses to represent bits of data. The encoder program codes each utilize one or more modulation techniques that uses principles of known digital modulation techniques. For example, the MP encoder program code can utilize a modulation technique such as amplitude shift keying (ASK), timing shift keying (TSK), or a combination thereof, including amplitude and timing shift keying (ATSK) to encode the telemetry data into a telemetry signal comprising mud pulses. Similarly, the EM encoder program can utilize a modulation technique such as ASK, frequency shift keying (FSK), phase shift keying (PSK), or a combination thereof such as amplitude and phase shift keying (APSK) to encode telemetry data into a telemetry signal comprising EM carrier waves. ASK involves assigning each symbol of a defined symbol set to a unique pulse amplitude. TSK involves assigning each symbol of a defined symbol set to a unique timing position in a time period.

Figure 3:
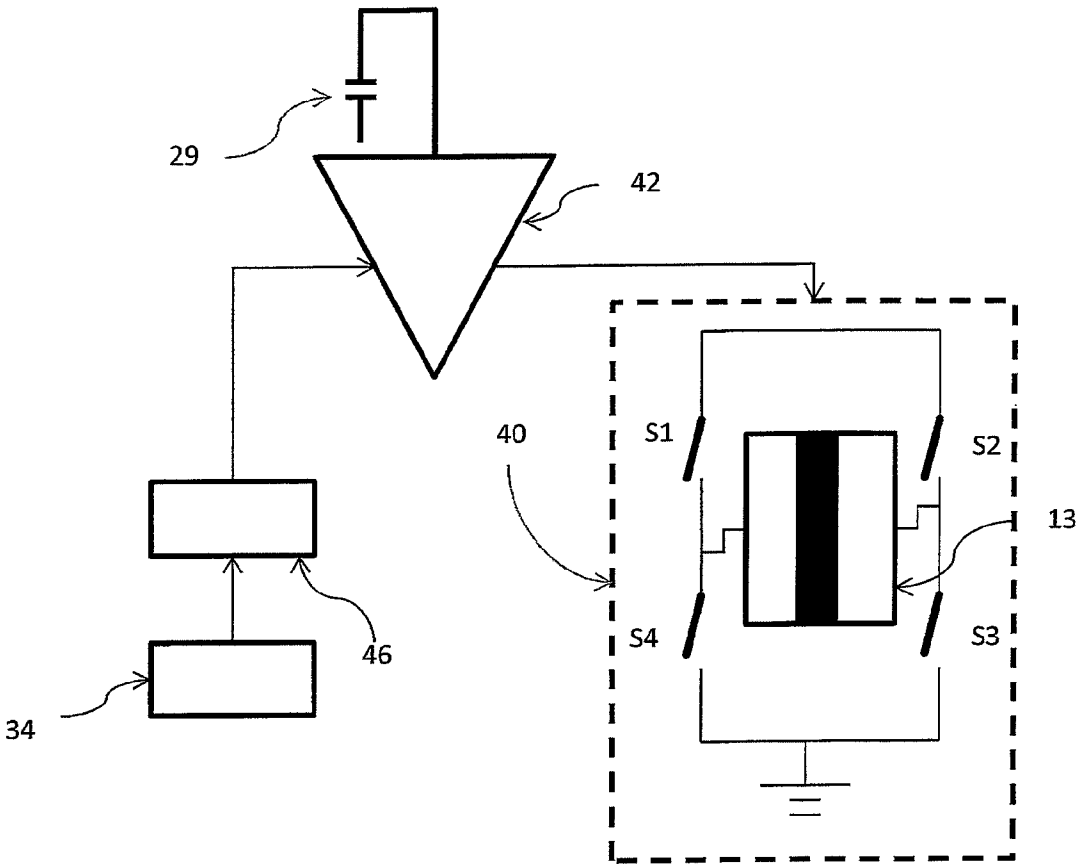
FIG. 3 is a schematic diagram of an EM signal generator of the EM telemetry unit.

Referring now to FIG. 3, the EM telemetry unit 13 is configured to generate EM carrier waves to carry the telemetry signal encoded by the modulation techniques discussed above; alternatively, but not shown, the EM telemetry unit 13 can be configured to generate EM pulses to carry the telemetry signal. The EM telemetry unit 13 comprises an H-bridge circuit 40, a power amplifier 42, and an EM signal generator 46. As is well known in the art, an H-bridge circuit enables a voltage to be applied across a load in either direction, and comprises four switches of which one pair of switches can be closed to allow a voltage to applied in one direction ("positive pathway"), and another pair of switches can be closed to allow a voltage to applied in a reverse direction ("negative pathway"). In the H-bridge circuit 40 of the EM signal generator 13, switches S1, S2, S3, S4 are arranged so that the part of the circuit with switches S1 and S4 is electrically coupled to one side of the gap sub 12 ("positive side"), and the part of the circuit with switches S2 and S3 are electrically coupled to the other side of the gap sub 12 ("negative side"). Switches S1 and S3 can be closed to allow a voltage to be applied across the positive pathway of the gap sub 12 to generate a positive carrier wave, and switches S2 and S4 can be closed to allow a voltage to applied across the negative pathway of the gap sub 12 to generate a negative carrier wave.

The signal generator 46 is communicative with the EM control module 34 and the amplifier 42, and serves to receive the encoded telemetry signal from the EM control module 34, and then translate the telemetry signal into an alternating current control signal which is then sent to the amplifier 42. The amplifier 42 is communicative with the signal generator 46, the batteries 39, and the H-bridge circuit 40 and serves to amplify the control signal received from the signal generator 46 using power from the batteries 39 and then send the amplified control signals to the H-bridge circuit 40 to generate the EM telemetry signal across the gap sub assembly 12.

Figure 4:
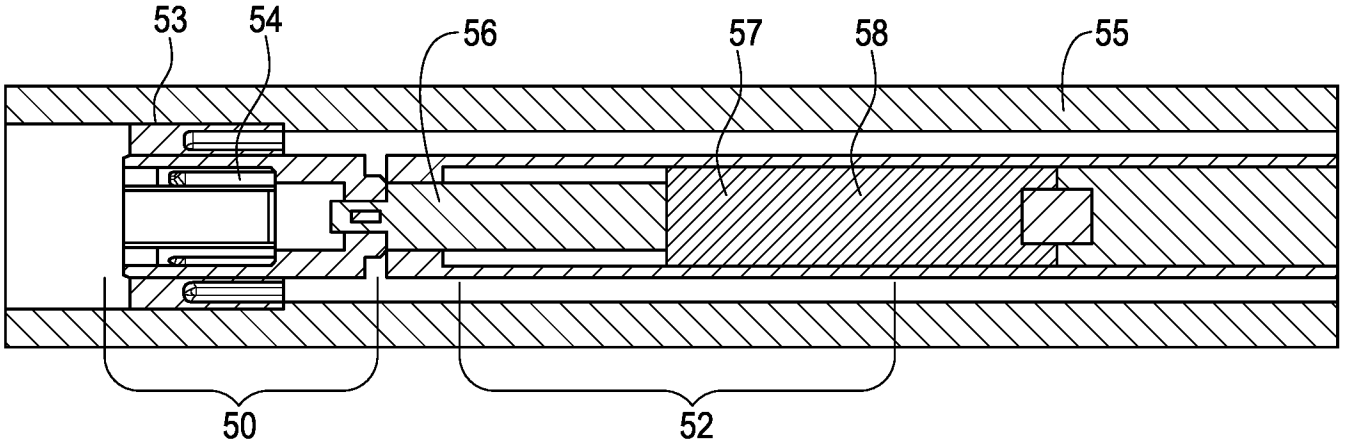
FIG. 4 is a longitudinally sectioned view of a mud pulser section of the MP telemetry unit.

Referring now to FIG. 4, the MP telemetry unit 28 is configured to generate mud pulses to carry the telemetry signal encoded by the modulation techniques discussed above. The MP telemetry unit 28 comprises a rotor and stator assembly 50 and a pulser assembly 52 both of which are axially located inside a drill collar 55 with an annular gap therebetween to allow mud to flow through the gap. The rotor and stator assembly 50 comprises a stator 53 and a rotor 54. The stator 53 is fixed to the drill collar 55 and the rotor 54 is fixed to a drive shaft 56 of the pulser assembly 52. The pulser assembly 52 is also fixed to the drill collar 55, although this is not shown in FIG. 4. The pulser assembly 52 also includes an electrical motor 57 which is powered by the batteries 39 and which is coupled to the drive shaft 56 as well as to associated circuitry 58 which is turn is communicative with the MP control module 36. The motor circuitry 58 receives the encoded telemetry signal from the control module and generates a motor control signal which causes motor 57 to rotate the rotor 54 (via the driveshaft 56) in a controlled pattern to generate pressure pulses in the drilling fluid flowing through the rotor 54.

Referring now to FIGS. 5 to 12, the telemetry tool 45 contains a set of configuration files which are executable by one or more of the control modules 33, 34, 35,36, 37 to operate the telemetry tool 45 to generate telemetry signals according to a selected operating configuration specified by instructions in the configuration file. The instructions will include the telemetry mode in which the telemetry tool 45 will operate, the type of message frames to be sent in the telemetry transmission, a composition of the message frame including the data type, timing and order of the data in each message frame, and a modulation scheme used to encode the data into a telemetry signal.

The set of configuration files can be downloaded onto the telemetry tool 45 when the tool 45 is at surface and connected to a download computer containing the set of configuration files (not shown); the connection can be made via USB cable from the computer to an interface port on the communications bus 40 (not shown). The number of configuration files in the set depends on the expected operations the rig will perform during its run. As will be discussed below in more detail, the telemetry tool 45 can be provided with a set of configuration files with one or more configuration files provided for one or more telemetry modes. When a set contains multiple configuration files per telemetry mode, each configuration file for that telemetry mode can specify different operating parameters for that telemetry mode; for example, in an EM-only telemetry mode, one configuration file can be provided with instructions for the telemetry tool 45 to encode measurement data using one type of modulation scheme (e.g. QPSK) and another configuration file can be provided with instructions for the telemetry tool 45 to encode measurement data using a different type of modulation scheme (e.g. FSK). Or, different configuration files can provide instructions for the EM telemetry unit 13 to transmit telemetry signals at different power outputs wherein a suitable configuration file is selected depending on the downhole location of the telemetry tool 45 and the accompanying attenuation of the Earth formation that must be overcome in order for the EM transmission to reach surface.

Once the operator determines how many configuration files should form the set of configuration files to be downloaded onto the telemetry tool 45, a download program on the download computer will determine which portion of each configuration file should be stored on each control module 33, 34, 35, 36, 37 of the telemetry tool 4. Once this determination has been made, the download software separates each configuration file into the determined portions and the download computer then transfers these determined portions to the memory of the appropriate control module 33, 34, 35, 36, 37. For example, instructions in the configuration file relating to operation of the EM telemetry unit 13 will be downloaded only to the memory of the EM control module 34.

Each stored configuration file portion is executable by the control module's CPU to carry out the instructions specified in the configuration file portion. For example, when the EM control module 34 executes a configuration file portion stored on its memory, the configuration file will include instructions for whether the EM telemetry unit 13 needs to be active for the telemetry mode specified in the configuration file. If the specified telemetry mode requires the EM telemetry to be active (e.g. the specified telemetry mode is EM-only), the EM control module 34 will read measurements taken by or more sensors 30, 31, 32 specified in the configuration file, encode the measurement data into an EM telemetry signal using a modulation scheme specified in the configuration file, and cause the components of the EM telemetry unit 13 to transmit the EM telemetry signal according to the message frame properties (e.g. type, composition, order, timing) specified in the configuration file.

The types of message frames that can be specified in a configuration file include a survey frame, a sliding (non-rotating at surface) frame, a rotating (at surface) frame, and a status (change) frame. The survey frame typically contains the highest priority data such as inclination, azimuth, and sensor qualification/verification. The sliding frame typically includes toolface readings and may also include additional data sent between successive toolface messages such as gamma readings. The rotating frame typically does not include toolface readings as such readings are not necessary when the pipe is rotating from surface. Any other measurement data can also be included in the rotating frame. The status frame can include data that is useful to alert the surface operator of a change in the telemetry type, speed, amplitude, configuration change, significant sensor change (such as a non-functioning or reduced-functioning accelerometer) or other unique changes that would be of interest to the operator. The status frame also can include an identifier which identifies which configuration file has been executed by the telemetry tool 45 to transmit the telemetry signals; this identifier will allow the surface receiving and processing equipment 18 to select the correct demodulation and other decoding operations to decode the received signals at surface.

Each message frame comprises a header section and a data section. The header section contains information that establishes the timing, amplitude and type of message frame. The header itself comprises two portions that are transmitted as one continuous stream, namely a front portion and a back portion. The front portion is a fixed waveform that has a unique pattern that can be recognized by the surface processing equipment and which is used to synchronize the surface processing equipment to the timing and amplitude of the telemetry transmission. The back portion is a variable waveform that identifies the type of the message frame. The composition of such messages frames are known in the art and thus not discussed in further detail here.

The telemetry modes that can be specified in a configuration file include: 1) MP-only telemetry mode, wherein only the MP telemetry unit 28 is used to send telemetry signals via mud pulses; 2) EM-only telemetry mode, wherein only the EM telemetry unit 13 is used to send telemetry signals via EM carrier waves or pulses; 3) concurrent shared telemetry mode wherein both EM and MP signal generators 13, 28 are used concurrently to transmit data, and wherein some of the data is sent by MP telemetry signals and the rest of the data is sent by EM telemetry signals; and 4) concurrent confirmation telemetry mode, wherein both EM and MP signal generators 13, 28 are used to transmit the same data.

The MP-only telemetry mode operates like a conventional MP telemetry transmission, wherein measurement and other data is encoded using a selected modulation scheme into a telemetry signal, and the mud pulse telemetry unit 28 will generate mud pulses in the drilling fluid which will propagate to the surface. Optionally however, survey data that has been acquired by the sensor 30, 32 can be transmitted by the EM telemetry unit 13, wherein the survey data is encoded into an EM telemetry signal and transmitted by the EM telemetry unit 13 during a drill string idle time, during a period of no mud flow and no drill string rotation. After the survey data has been transmitted, the EM telemetry unit 13 will power off and the other measurement data is transmitted by the MP telemetry unit 28.

The EM-only telemetry mode operates like a conventional EM telemetry transmission, wherein measurement and other data is encoded using a selected modulation scheme into a telemetry signal, and the EM telemetry unit 13 will generate an EM carrier wave or pulses which will propagate through the Earth formation to the surface.

The concurrent shared mode operates like two separate telemetry systems independent of the other, each transmitting a separate channel of telemetry data. The configuration file will include instructions for each of the MP and EM telemetry units 13, 28 to obtain certain measurement data from the sensors 30, 31, 32 and encode and transmit this data. For example, a configuration file can include instructions for the EM control module 34 to read gamma, shock and vibration measurements and encode these measurements into an EM telemetry signal, and instructions for the MP control module 36 to read toolface measurements and encode these measurements into a MP telemetry signal. More particularly, a configuration file can contain instructions to cause more critical measurement data to be transmitted by the telemetry unit which is expected to be more reliable or faster during the present drilling conditions, and less critical measurement data to be transmitted by the other telemetry unit.

The configuration file can also include instructions for the EM and MP telemetry units 13, 28 to transmit some of the same measurement data, such as toolface data; this can be useful when it is important for the accuracy of certain data to be verified. It such cases, the configuration file can instruct the respective EM and MP telemetry units to obtain the same measurement data at the same time, i.e. to synchronize the reading of the measurement data from the relevant sensors.

In one embodiment of the concurrent shared telemetry mode, one telemetry unit 13, 28 will transmit its telemetry signal regardless of whether the other telemetry unit 13, 28 is functioning or has failed. As will be described in more detail below, the telemetry tool 45 can switch telemetry modes upon receipt of a downlink command from a surface operator, such as a command to switch from the concurrent shared mode to the MP-only mode when the operator detects that the EM telemetry unit 13 has failed. In another embodiment, a telemetry unit 13, 28 which has failed or is not functioning properly is programmed to send a signal over the communications bus 40. The other telemetry unit 13, 28 which is still functioning will upon receipt of this signal, obtain measurement data from the sensors 30, 31, 32 which were supposed to be obtained by the failed telemetry unit 13, 28, in addition to the measurement data the functioning telemetry unit has already been programmed to obtain.

The concurrent confirmation mode synchronizes the operation of the EM and MP telemetry units 13, 28, so that the same data is transmitted by both telemetry units 13, 28 and which can be received and compared to each other at surface by the surface receiving and processing equipment 18. In this mode, one of the telemetry units 13, 28 is designated to be the primary or main transmitter; the MP telemetry unit 28 is typically set as the default primary transmitter. The control module for the primary telemetry unit controls the measurements data requests to the sensors 30, 31, 32 and mirrors the received measurement data to the control module of the other telemetry unit. The flow and RPM sensor measurement data are used to set the timing for transmitted EM and MP telemetry data; in other words, the flow and RPM sensor measurement data is used to synchronize the timing of the MP and EM telemetry transmissions.

Figure 5:
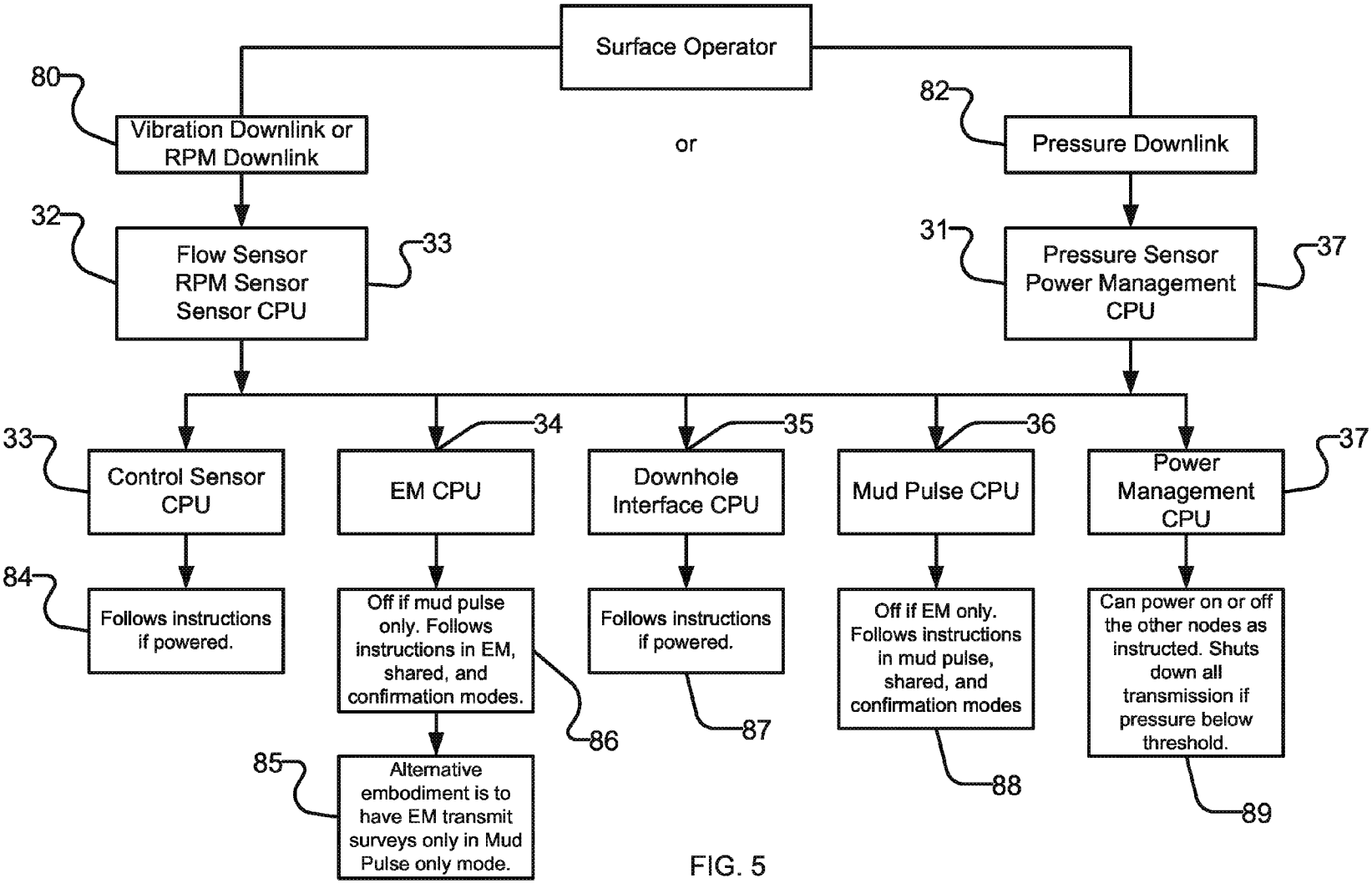
FIG. 5 is a block diagram of a plurality of processors of the downhole MWD tool and their respective operations that are carried out in response to a downlink command.

Referring particularly to FIG. 5, the telemetry tool 45 is programmed to change its operating configuration when the telemetry tool 45 receives a downlink command containing instructions to execute a particular configuration file. The surface operator can send a downlink command by vibration downlink 80, RPM downlink 81, or pressure downlink 82 in a manner as is known in art. Flow and RPM sensors of the drilling conditions sensors 32 can receive the vibration downlink 80 or RPM downlink 81 commands; the pressure sensor 31 can receive the pressure downlink 82 command. Upon receipt of a downlink command analog signal, the CPU of the control sensor control module 33 or power management control module 37 will decode the received signal and extract the bitstream containing the downlink command instructions, in a manner that is known in the art. The control sensor control module 33 will then read the downlink command instructions and execute the configuration file portion stored on its memory corresponding to the configuration file specified in the downlink command, as well as forward the downlink command instructions to the other control modules 33, 34, 35, 36, 37 via the communications bus 40. Upon receipt of the downlink command instructions, the CPUs of the other control modules 33, 34, 35, 36, 37 will also execute the configuration file portions in their respective memories that correspond to the configuration file specified in the downlink command. In particular: the control sensor control module 33 will operate its sensors 32 when instructed to do so in the configuration file (step 84); the EM control module 34 will turn off when the configuration file specifies operation in the MP-only mode or alternatively only transmit survey data in the MP-only mode (step 85), and will operate the EM telemetry unit 13 according to the instructions in its configuration file portion when the configuration file portion specifies operation in the EM-only, concurrent shared, or concurrent confirmation mode (step 86); the interface control module 35 will operate its sensors when instructed to do so in its configuration file portion (step 87); the MP control module 36 will turn off when its configuration file portion specifies operation in the EM only mode and will operate the MP telemetry unit 28 when its configuration file portion specifies operation in the MP-only, concurrent shared, or concurrent confirmation mode (step 88); and the power management control module 37 will power on or power off the other control modules 33-36 as instructed in its confirmation file portion, and will otherwise operate to manage power usage in the telemetry tool 45 and shut down operation when a measured pressure is below a specified safety threshold (step 89).

Figure 6:
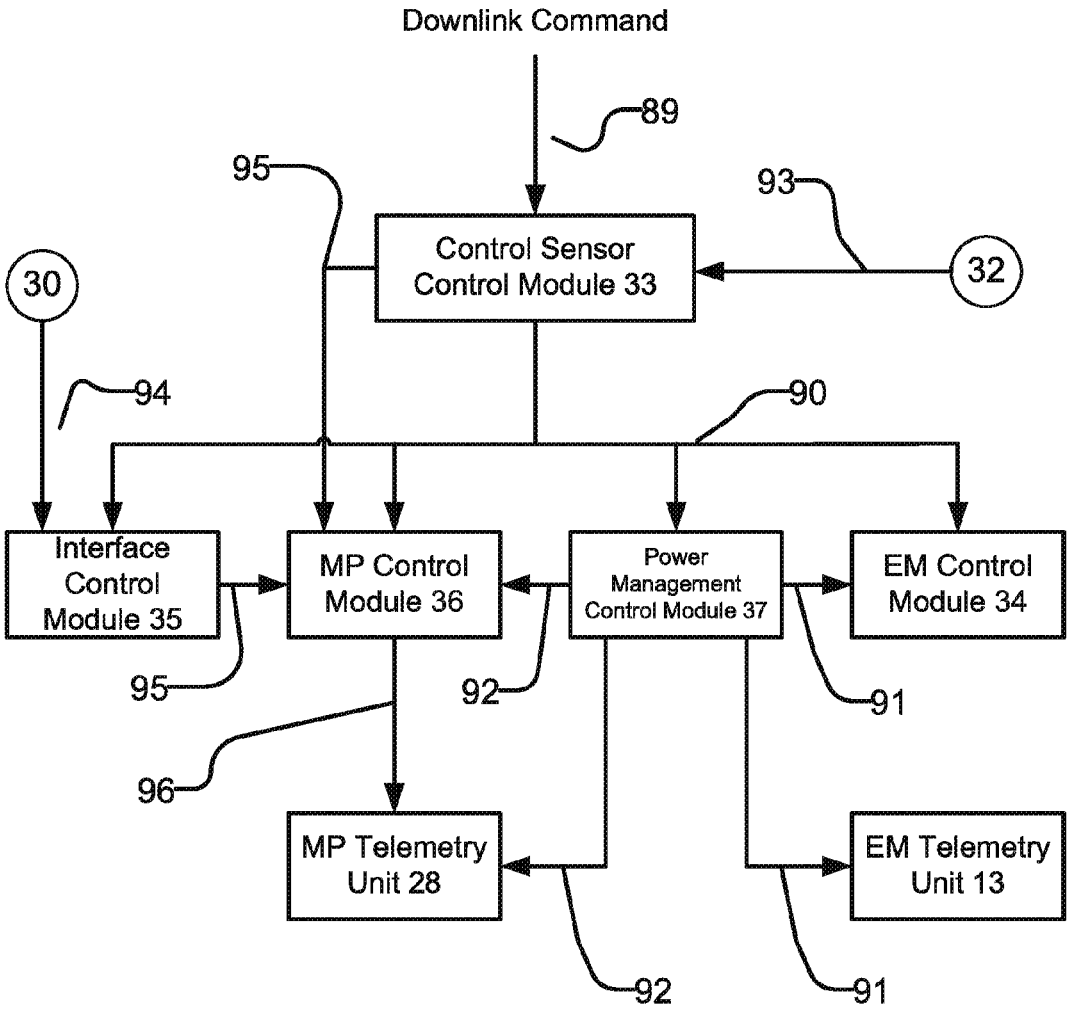
FIG. 6 is a flow chart of steps performed by the MWD telemetry tool while operating in an MP Only telemetry mode.
Figure 7:
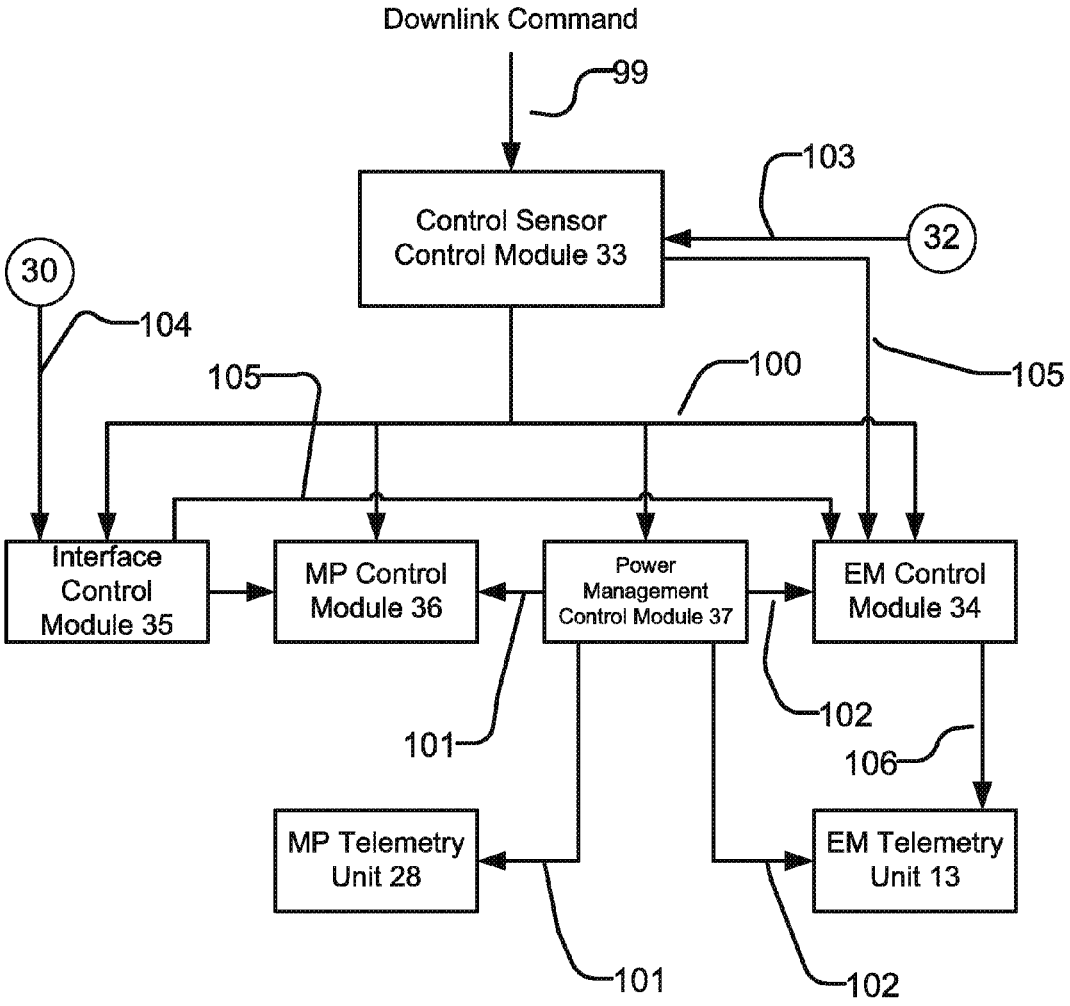
FIG. 7 is a flow chart of steps performed by the MWD telemetry tool while operating in an EM Only telemetry mode.
Figure 8:
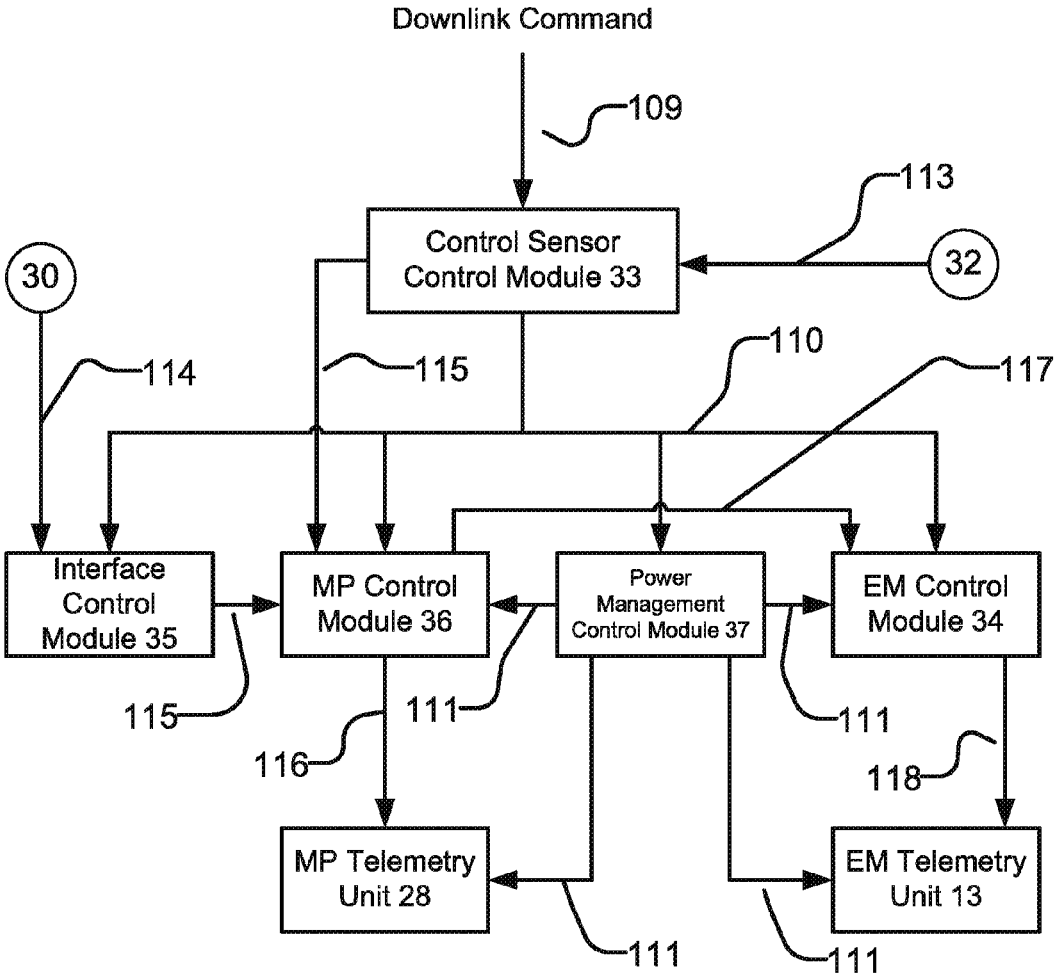
FIG. 8 is a flow chart of steps performed by the MWD telemetry tool while operating in a concurrent confirmation mode.
Figure 10:
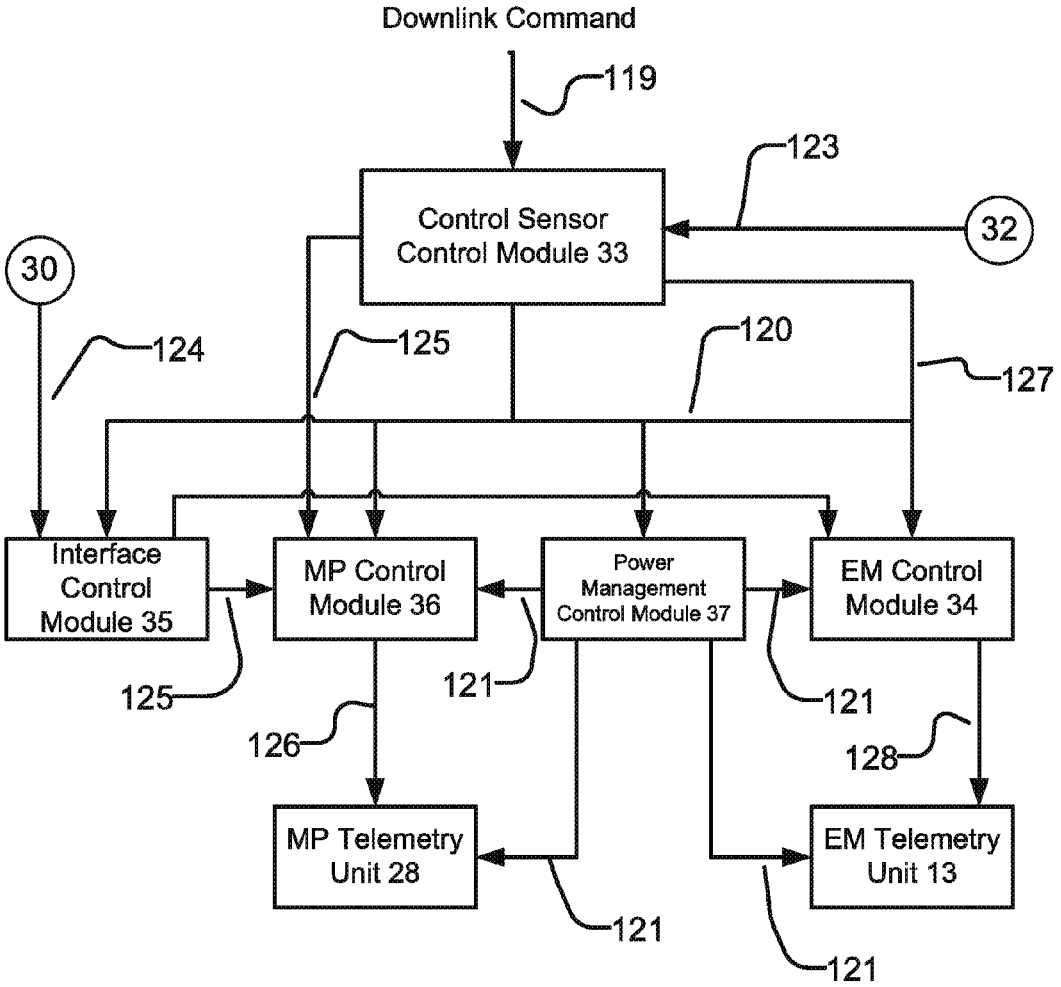
FIG. 10 is a flow chart of steps performed by the MWD telemetry tool while operating in a concurrent shared mode.

FIGS. 6 to 8 and 10 provide examples of four different configuration files, and the steps performed by each of the control modules 33, 34, 35, 36, 37 upon execution of the instructions in the portions of each of these configuration files stored in their respective memories. In these examples, it is assumed that the telemetry tool 45 is already operating according to a configuration that requires both EM and MP telemetry units to be active, and the drilling conditions sensors 32 receive a vibration or RPM downlink command to execute a new configuration file, namely one of the four configuration files shown in FIGS. 6, to 8 and 10. In FIG. 6, a first configuration file is shown which includes instructions for the telemetry tool 45 to operate in a MP-only mode. In FIG. 7, a second configuration file is shown which includes instructions for the telemetry tool 45 to operate in an EM-only mode. In FIG. 8, a third configuration file is shown which includes instructions for the telemetry tool 45 to operate in a concurrent confirmation mode. In FIG. 10, a fourth configuration file is shown which includes instructions for the telemetry tool 45 to operate in a concurrent shared mode.

Referring to FIG. 6, the control sensor control module 33 decodes the downlink command signal (step 89) to obtain the downlink command instructions to execute the first configuration file and forwards these downlink command instructions to the other control modules 34, 35, 36, 37 (step 90). The power management control module 37 upon execution of its first configuration file portion opens power supply switches to the EM control module 34 and EM telemetry unit 13 (step 91) to power off these devices, and closes power supply switches to the MP CPU 36 and MP telemetry unit 28 to power on these devices (step 92) if these switches are not already closed (which in this example they are already closed). The control sensor control module 33 upon execution of its first configuration file portion reads flow state and RPM state information from its sensors 32 (step 93). The interface control module 35 upon execution of its first configuration file portion reads D&I state and gamma state from its sensors 30 (step 94). The MP control module 36 upon execution of its first configuration file portion reads the measurement data taken by sensors 30, 32 (step 95) and sets the timing of the telemetry transmission based on the flow and RPM measurements, and then operates the MP telemetry unit 28 in the manner specified in its configuration file portion, which includes encoding the measurement data according to a specified the modulation scheme, and having a specified message frame type, composition, and timing, operating the MP motor to operate the mud pulser 52 to generate mud pulse telemetry signals (step 96).

Referring to FIG. 7, the control sensor control module 33 decodes the downlink command signal (step 99) to obtain the downlink command instructions to execute the second configuration file and forwards these downlink command instructions to the other control modules 34, 35, 36, 37 (step 100). The power management control module 37 upon execution of its second configuration file portion opens power supply switches to the MP control module 36 and MP telemetry unit 28 (step 101) to power off these devices, and closes power supply switches to the EM CPU 34 and EM telemetry unit 13 to power on these devices (step 102) if these switches are not already closed (which in this example they are already closed). The control sensor control module 33 upon execution of its second configuration file portion reads flow state and RPM state information from its sensors 32 (step 103). The interface control module 35 upon execution of its second configuration portion file reads D&I state and gamma state from its sensors 30 (step 104). The EM control module 34 upon execution of its second configuration file portion reads the measurement data taken by sensors 30, 32 and sets the timing of the telemetry transmission based on the flow and RPM measurements (step 105) and operates the EM telemetry unit 13 in the manner specified in its configuration file portion, which include encoding the measurement data using a specified modulation scheme, and having a specified message frame type, composition and timing, operating the EM signal generator 46 to generate an AC telemetry signal, amplifying this signal with the amplifier 42 and applying the signal across the gap sub 12 via the H-bridge circuit 40 (step 106).

Referring to FIG. 8, the control sensor control module 33 decodes the downlink command signal (step 109) to obtain the downlink command instructions to execute the third configuration file and forwards these downlink command instructions to the other control modules 34, 35, 36, 37 (step 110). The power management control module 37 upon execution of its third configuration file portion (step 111) closes the power switches to both the EM control module 34/telemetry unit 13 and the MP control module 36/telemetry unit 28 to power on these devices, if these switches are not already closed (in this example both are already closed). The control sensor control module 33 upon execution of its third configuration file portion reads flow state and RPM state information from its sensors 32 (step 113). The interface control module 35 upon execution of its third configuration file portion reads D&I state and gamma state from its sensors 30 (step 114). The MP control module 36 upon execution of its third configuration file portion reads the measurement data taken by sensors 30, 32 and sets the timing of the telemetry transmission based on the flow and RPM measurements (step 115), and then operates the MP telemetry unit 28 in the manner specified in the configuration file to generate mud pulse telemetry signals (step 116). The EM control module 34 upon execution of its third configuration file portion communicates with the MP control module 36 to obtain the read measurement data (in a "mirrored data" operation) and sets the timing of the telemetry transmission based on the flow and RPM measurements (step 117) and operates the EM telemetry unit 13 in the manner specified in the configuration file to generate EM telemetry signals (118).

Figure 11:
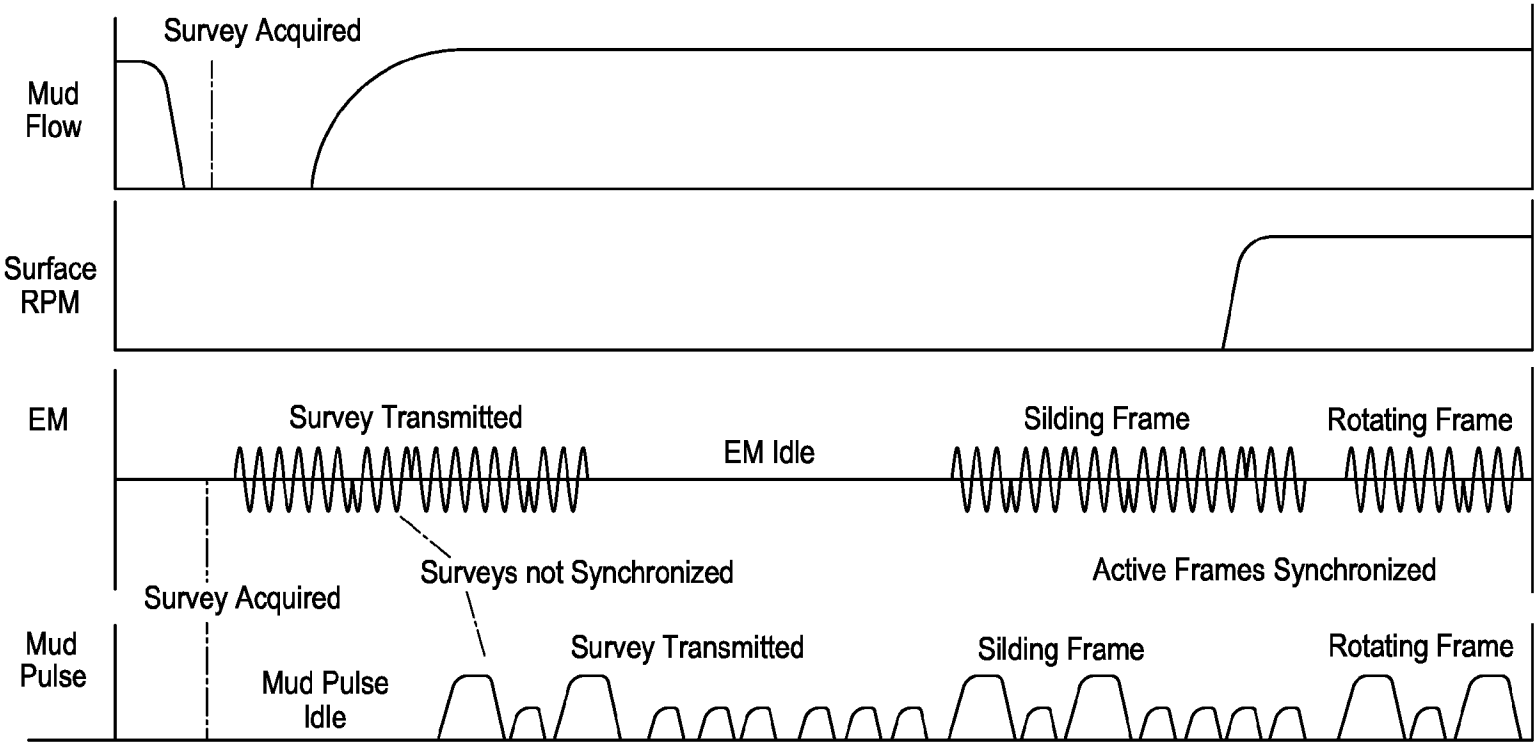
FIG. 11 is a graph of mud flow, drill string rotation speed, EM telemetry transmission and MP telemetry transmission as a function of time when the MWD telemetry tool is operating in the concurrent confirmation mode.

The third configuration file portions for the MP and EM control modules 34, 36 will include instructions relating to the type, composition, order and timing of the message frames in both the EM and MP telemetry transmissions. Referring to FIG. 11, the third configuration file can include, for example, instructions for the interface module 35 to take survey measurements using sensors 30 and for the EM telemetry unit 13 to transmit a survey message frame containing the survey measurements during a "quiet" window while there is no mud flow or drill string rotation. Since mud flow is required for MP transmissions, the third configuration file can also include instructions for the MP telemetry unit 28 to transmit a survey message frame while mud is flowing and before the drill string rotates. Since the telemetry tool is operating in a concurrent confirmation mode, the third configuration file can also contain instructions for the EM and MP telemetry units 13, 28 to each send time-synchronized sliding frames containing the same data when mud is flowing and the drill string is not rotating. Finally, the third configuration file can include instructions for the EM and MP telemetry units 13, 28 to then send time-synchronized rotating frames containing the same data when mud is flowing and the drill string is rotating.

Referring to FIG. 10, the control sensor control module 33 decodes the downlink command signal (step 119) to obtain the downlink command instructions to execute the fourth configuration file and forwards these downlink command instructions to the other control modules 34, 35, 36, 37 (step 120). The power management control module 37 upon execution of its third configuration file portion (step 121) closes the power switches to both the EM control module 34/telemetry unit 13 and the MP control module 36/telemetry unit 28 to power on these devices, if these switches are not already closed (in this example both are already closed). The control sensor control module 33 upon execution of its fourth configuration file portion reads flow state and RPM state information from its sensors 32 (step 123). The interface control module 35 upon execution of its fourth configuration file portion reads D&I state and gamma state from its sensors 30 (step 124). The MP control module 36 upon execution of its fourth configuration file portion reads the measurement data taken by sensors 30, 32 and sets the timing of the telemetry transmission based on the flow and RPM measurements (step 125), and then operates the MP telemetry unit 28 in the manner specified in the configuration file to generate mud pulse telemetry signals (step 126). The EM control module 34 upon execution of its fourth configuration file portion reads the measurement data taken by sensors 30, 32 (in a "independent data acquisition" operation) and sets the timing of the telemetry transmission based on the flow and RPM measurements (step 127) and operates the EM telemetry unit 13 in the manner specified in the configuration file to generate EM telemetry signals (128).

Figure 12:
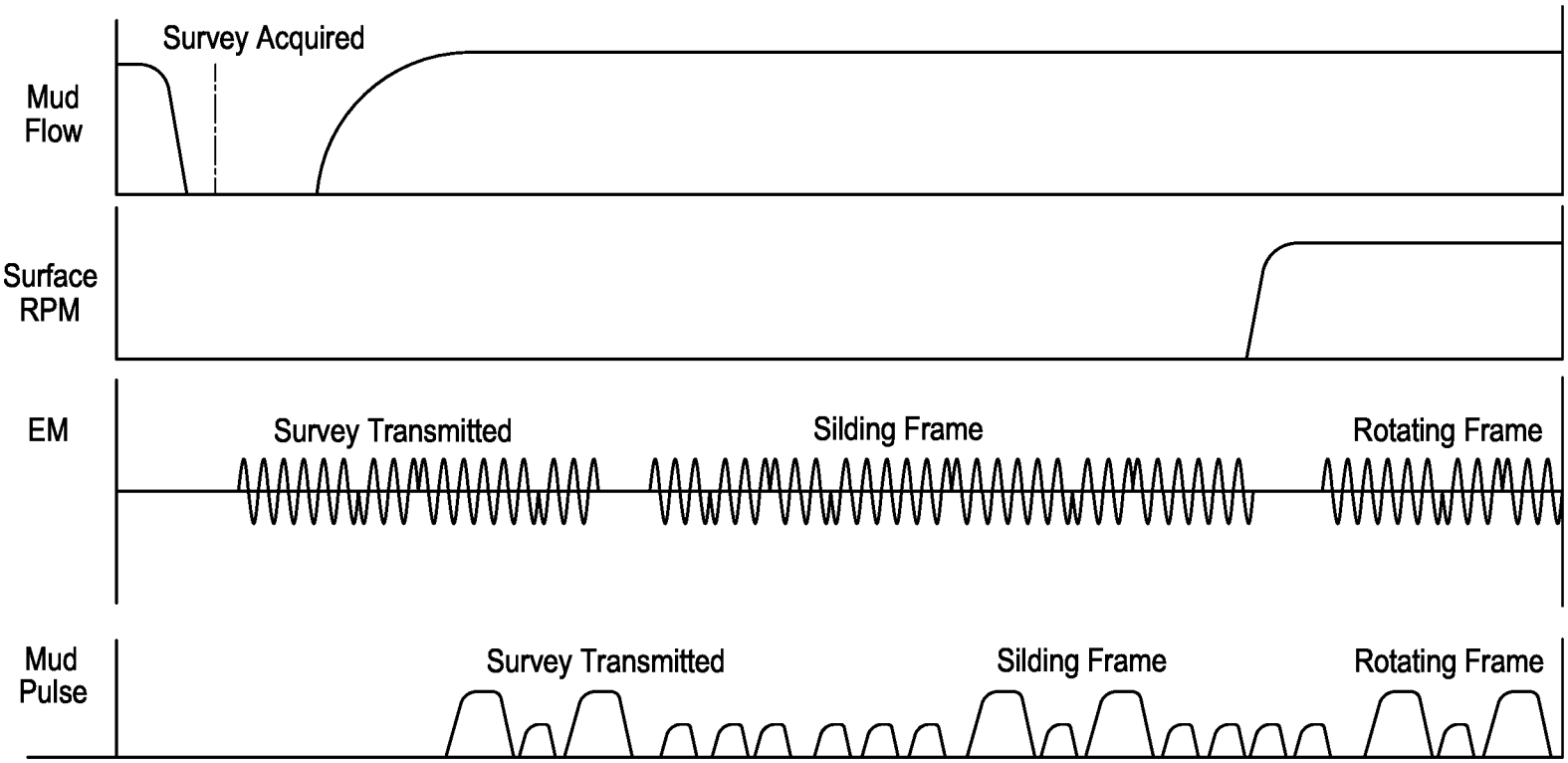
FIG. 12 is a graph of mud flow, drill string rotation speed, EM telemetry transmission and MP telemetry transmission as a function of time when the MWD telemetry tool is operating in the concurrent shared mode.

The fourth configuration file portions for the MP and EM control modules 34, 36 will include instructions relating to the type, composition, order and timing of the message frames in both the EM and MP telemetry transmissions. Referring to FIG. 12, the fourth configuration file can include, for example, instructions for the interface module 35 to take survey measurements using sensors 30 and for the EM telemetry unit 13 to transmit a survey message frame containing the survey measurements during a "quiet" window while there is no mud flow or drill string rotation. Since mud flow is required for MP transmissions, the fourth configuration file can also include instructions for the MP telemetry unit 28 to transmit a survey message frame while mud is flowing and before the drill string rotates. Since the telemetry tool is operating in a concurrent shared mode, the fourth configuration file can also contain instructions for each of EM and MP telemetry units 13, 28 to independently send different data as specified by the configuration file. For example, the fourth configuration can contain instructions for the EM telemetry unit 13 to transmit gamma, shock and vibration measurements in sliding and rotating frames, and for the MP telemetry unit 28 to transmit toolface measurements in sliding and rotating frames.

Surface Receiving and Processing Equipment

Figure 13:
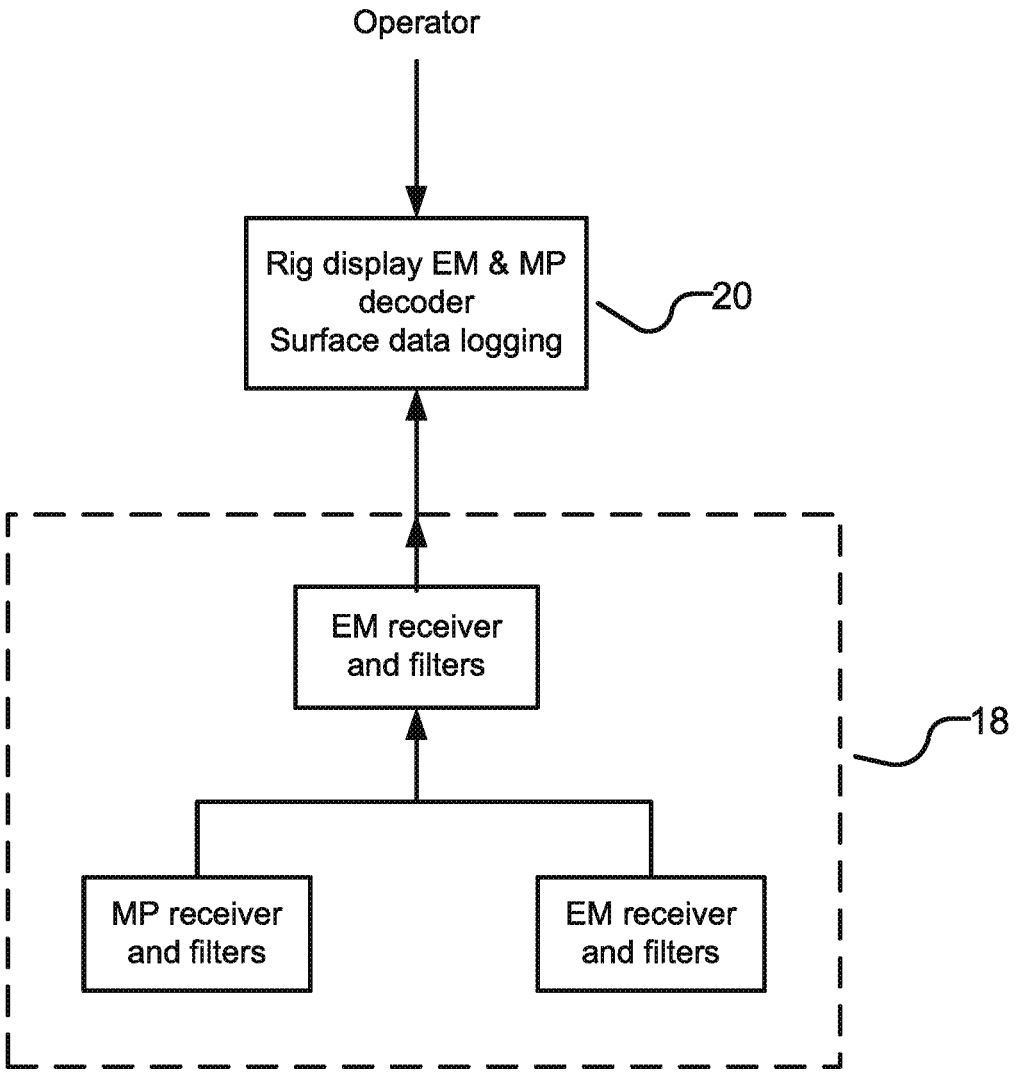
FIG. 13 is a schematic block diagram of components of the surface receiving and processing equipment.

Referring now to FIG. 13, the receiver box 18 detects and processes the EM and MP telemetry signals transmitted by the telemetry tool, and sends these signals to the computer 20 which decodes these signals to recover the telemetry channels and to convert measurement data for use by the operator. The computer 20 includes executable program code containing a demodulation technique(s) corresponding to the selected modulation technique(s) used by the EM and MP telemetry units 13, 28, which are used to decode the modulated telemetry signals. The computer 20 also contains the same set of configuration files that were downloaded onto the telemetry tool 45, and will refer to the specific configuration file used by the telemetry tool 45 to decode the received telemetry signals that were transmitted according to that configuration file.

The receiver box 18 includes a MP receiver and filters, an EM receiver and filters, and a central processing unit (receiver CPU) and an analog to digital converter (ADC). More particularly, the receiver box 18 comprises a surface receiver circuit board containing the MP and EM receivers and filters. The EM receiver and filter comprises a preamplifier electrically coupled to the communication cables 17 to receive and amplify the EM telemetry transmission comprising the EM carrier wave, and a band pass filter communicative with the preamplifier configured to filter out unwanted noise in the transmission. The ADC is also located on the circuit board and operates to convert the analog electrical signals received from the EM and MP receivers and filters into digital data streams. The receiver CPU contains a digital signal processor (DSP) which applies various digital signal processing operations on the data streams by executing a digital signal processing program stored on its memory. Alternatively, separate hardware components can be used to perform one or more of the DSP functions; for example, an application-specific integrated circuit (ASIC) or field-programmable gate arrays (FPGA) can be used to perform the digital signal processing in a manner as is known in the art. Such preamplifiers, band pass filters, and A/D converters are well known in the art and thus are not described in detail here. For example, the preamplifier can be a INA118 model from Texas Instruments, the ADC can be a ADS 1282 model from Texas Instruments, and the band pass filter can be an optical band pass filter or an RLC circuit configured to pass frequencies between 0.1 Hz to 20 Hz.

The computer 20 is communicative with the receiver box 18 via an Ethernet or other suitable communications cable to receive the processed EM and MP telemetry signals and with the surface operator to receive the identity of the configuration file the telemetry tool 45 is using to transmit the telemetry signals ("operating configuration file"). The computer 20 in one embodiment is a general purpose computer comprising a central processing unit (CPU and herein referred to as "surface processor") and a memory having program code executable by the surface processor to perform various decoding functions including digital signal-to-telemetry data demodulation. The computer 20 can also include program code to perform digital signal filtering and digital signal processing in addition to or instead of the digital signal filtering and processing performed by the receiver box 18.

The surface processor program code utilizes a demodulation technique that corresponds specifically to the modulation technique used by the telemetry tool 45 to encode the measurement data into the EM telemetry signal. Similarly, the program code utilizes a demodulation technique used by the telemetry tool 45 to encoded the measurement data into the MP telemetry signal. These modulation techniques is applied to the EM and MP telemetry signals received from the telemetry box 18 to recover the measurement data.

Alternatively, or additionally, the receiver box 18 and/or computer 20 are programmed to retrieve the identity of the operating configuration file used by the telemetry tool 45 from the telemetry signals themselves. The identity of the operating configuration file can be located in the status frame, or another message frame. The operating configuration file identity can also be repeated in the telemetry signal, e.g. at the end of a survey frame.

Alternatively, or in the event that the receiver box 18 and/or computer 20 cannot retrieve the identity of the operating configuration file from the telemetry signal, or does not receive the identity of the operating configuration file from the operator, or there is a mismatch between the identities detected in the telemetry signal and provided by the operator, the surface receiving and processing equipment 18 can be programmed to attempt to decode the received telemetry transmission in all known telemetry modes and using all known demodulation techniques until the correct telemetry mode and demodulation technique is found.

The computer 20 further contains program code executable by the surface processor to process telemetry signals transmitted by the telemetry tool 45 in the concurrent shared or confirmation modes. More particularly, when the transmission was made in the concurrent shared mode, program code will be executed which combines the measurement data from the MP and EM data channels into a single data stream for display to the operator. When the transmission was made in the concurrent confirmation mode, program code will be executed which compares the received EM and MP telemetry signals and selects the telemetry signal providing the highest confidence value to decode and obtain the measurement data.

For transmissions made in the concurrent confirmation mode and referring to FIG. 9, the surface receiver box 18 and computer 20 will process and decode each EM and MP telemetry signal into their respective measurement data sets. The computer 20 will perform an error check bit matching protocol against each decoded data set and then assign a confidence value to each data set. The central control module 220 can use error check bit matching protocols known in the art, such as a 1 bit parity check or a 3 bit cyclic redundancy check (CRC). More particularly, the downhole telemetry tool 45 can add CRC bits at the end of the telemetry signal ("telemetry data bits"), and the surface receiving and processing equipment 18 decoders will be provided with the matching CRC bits ("error check bits") that will be compared to the CRC bits in the telemetry signals to determine if there were errors in the telemetry signal.

In one embodiment, each data set can be assigned one of three confidence values corresponding to the following:

- High confidence—telemetry data bits match error check bits
- Medium confidence—telemetry data bits only match error check bits after modification of selected thresholds, e.g. amplitude threshold No confidence—telemetry data bits do not match error check bits, even after modification of selected thresholds.

The surface receiving and processing equipment 18 will also determine the signal to noise ratio of each received EM and MP telemetry in a manner that is known in the art.

The central control module 220 then compares the EM and MP data sets, and determines whether the data sets are sufficiently similar to meet a predefined match threshold; if yes, then the data sets are considered to match. More particularly, when both data sets are encoded using the same number of bits, the decoded data sets should have an exact match. When the data sets are encoded using different numbers of bits to represent the same measurement data, the match threshold is met so long as the error between the two decoded data sets is within a specified range, e.g. less than the difference between a 1 bit change.

When the two data sets match and both have at least at medium confidence value, then either data set can be used to recover the measurement data. When the EM and MP data sets do not match, and both EM and MP data sets are assigned the same high or medium confidence value, the central control module 220 will select the data set having the highest detected signal-to-noise ratio. When the EM and MP data sets do not match and the MP and EM data sets are assigned different confidence values, the control module 220 selects the data set having the highest confidence value. When both the EM and MP data sets are assigned a no confidence value, the central control module 220 outputs a "no data" signal indicating that neither data set is usable.

By offering a variety of different telemetry modes in which telemetry signals can be transmitted by the telemetry tool 45 and received by the surface receiving and processing equipment 18, the telemetry system offers an operator great operational flexibility. The telemetry tool 45 can be instructed to transmit as the highest baud rate available under current operating conditions; for example, if the telemetry tool 45 is at a location that the EM telemetry unit 13 must transmit an EM telemetry signal at a very low frequency in order to reach surface and which results in a baud rate that is lower than the baud rate of the MP telemetry unit 28, the surface operator can send a downlink command to instruct the telemetry tool 45 to transmit using the MP telemetry unit 28. Further, the telemetry tool 45 can be instructed to transmit in one telemetry mode when the operating conditions do not allow transmission in the other telemetry mode; for example, the telemetry tool 45 can be instructed to transmit in the EM-only telemetry mode when no mud is flowing. Further, the telemetry tool 45 can be operated in a concurrent shared mode effectively double the number of telemetry channels thereby increasing the overall data transmission bandwidth of the telemetry tool 45. Further, the reliability of the telemetry tool 45 can be increased by transmitting in the concurrent confirmation mode and selecting the telemetry data having the highest confidence value.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of the general concept.

What is claimed is:

1. A method of transmitting downhole measurement data to surface comprising:

(a) reading downhole measurement data;

(b) selecting an available telemetry transmission mode from a group consisting of: mud pulse (MP)-only telemetry mode, electromagnetic (EM)-only telemetry mode, MP and EM concurrent shared telemetry mode, and MP and EM concurrent confirmation telemetry mode;

(c) when the MP-only telemetry mode is selected, encoding the measurement data into a first MP telemetry signal and transmitting the first MP telemetry signal to surface, (d) when the EM-only mode is selected, encoding the measurement data into a first EM telemetry signal and transmitting the first EM telemetry signal to surface;

(e) when the concurrent shared telemetry mode is selected, encoding a first selection of the measurement data into a second MP telemetry signal and a second selection of the measurement data into a second EM telemetry signal, transmitting the second MP and EM telemetry signals to surface and, at the surface, receiving the second MP and EM telemetry signals and combining the first and second selections of measurement data from the second MP and second EM telemetry signals into a single data stream; and (f) when the concurrent confirmation telemetry mode is selected, encoding the same measurement data into a third MP telemetry signal and into a third EM telemetry signal; and transmitting the third MP and EM telemetry signals to surface.

2. The method according to claim 1 comprising, when the concurrent shared telemetry mode is selected, encoding gamma, shock and vibration data into the second EM telemetry signal and encoding toolface data into the second MP telemetry signal.

3. The method according to claim 1 comprising, when the concurrent shared telemetry mode is selected, encoding gamma and toolface data on the second EM telemetry signal and encoding shock and vibration data on the second MP telemetry signal.

4. The method according to claim 1 comprising, when the concurrent shared telemetry mode is selected, encoding gamma data on the second EM telemetry signal and encoding shock, vibration and toolface data on the second MP telemetry signal.

5. The method according to claim 1 comprising, when the concurrent shared telemetry mode is selected, obtaining survey data, encoding at least some of the survey data into an EM telemetry signal survey frame and encoding at least some of the survey data into an MP telemetry signal survey frame, transmitting at least part of the EM telemetry signal survey frame during a period of no mud flow, and transmitting the MP survey frame during a period of mud flow.

6. The method according to claim 1 comprising, changing the selection of telemetry mode in response to a downlink command.

7. The method according to claim 1 comprising, when the concurrent shared telemetry mode is selected, determining which one of the EM and MP telemetry modes is faster or more reliable under present drilling conditions and making the first and second selections of the measurement data such that a more critical part of the measurement data is transmitted by the one of the EM and MP telemetry modes which is faster or more reliable and a less critical part of the measurement data is transmitted by the other one of the MP and EM telemetry modes.

8. The method according to claim 1 comprising providing a configuration file corresponding to the concurrent shared telemetry mode and, upon selection of the concurrent shared telemetry mode executing the configuration file.

9. The method according to claim 8 wherein executing the configuration file comprises executing a portion of the configuration file by processors of each of a plurality of modules.

10. The method of claim 8 wherein the configuration file comprises instructions for each of a MP telemetry unit and an EM telemetry unit to obtain specified measurement data from downhole sensors and encode and transmit the specified measurement data.

11. The method of claim 10 wherein the configuration file comprises instructions to energize the MP telemetry unit and the EM telemetry unit and executing the configuration file comprises energizing the MP telemetry unit and the EM telemetry unit.

12. The method of claim 1 comprising, when the concurrent confirmation telemetry mode is selected, at the surface, receiving and decoding the third MP and EM telemetry signals to yield corresponding data sets, performing an error check bit matching protocol against each decoded data set and assigning a confidence value to each data set.

13. The method of claim 12 comprising, at the surface, measuring a signal to noise ratio of the received third EM and MP telemetry signals.

14. The method of claim 1 comprising, when the concurrent confirmation telemetry mode is selected, encoding the same measurement data using different numbers of bits for transmission in the third MP and EM telemetry signals respectively.

15. The method according to claim 1 comprising obtaining flow and RPM measurements and, when the concurrent shared telemetry mode is selected setting timing of transmission of the second EM telemetry signal based on the flow and RPM measurements.

16. The method according to claim 1 comprising obtaining flow and RPM measurements and, when the concurrent shared telemetry mode is selected setting timing of transmission of the second MP telemetry signal based on the flow and RPM measurements.

* * * * *